US005149402A

United States Patent [19]

Riddick

[11] Patent Number: 5,149,402

[45] Date of Patent: Sep. 22, 1992

[54] HEADBOX HAVING A PRIMARY STOCK FLOW AND A LATERALLY INJECTED SECONDARY FLOW

[75] Inventor: Ian W. Riddick, Bury, England

[73] Assignee: Beloit Corporation, Beloit, Wis.

[21] Appl. No.: 316,571

[22] Filed: Feb. 27, 1989

Related U.S. Application Data

[63] Continuation of Ser. No. 204,046, Jun. 8, 1988, abandoned, which is a continuation-in-part of Ser. No. 84,610, Aug. 10, 1987, abandoned.

[30] Foreign Application Priority Data

May 14, 1987 [GB] United Kingdom ..... 87 11330

[51] Int. Cl.[5] ..... D21F 1/02

[52] U.S. Cl. ..... 162/336; 162/216; 162/343

[58] Field of Search ..... 162/212, 216, 263, 336–340, 162/343, 344, 347

[56] References Cited

U.S. PATENT DOCUMENTS

| | | | |
|---|---|---|---|
| 2,904,461 | 9/1959 | Washburn et al. | 162/216 |
| 2,956,623 | 10/1960 | Ikavalko | 162/216 |
| 3,493,463 | 2/1970 | Baker | 162/336 |
| 3,853,695 | 10/1974 | Back et al. | 162/338 |
| 3,888,729 | 6/1975 | Parker et al. | 162/336 |
| 3,902,961 | 9/1975 | Roerig et al. | 162/216 |
| 4,285,767 | 8/1981 | Page | 162/216 |
| 4,687,548 | 8/1987 | Ilmoriemi et al. | 162/336 |
| 4,898,643 | 2/1990 | Weisshuhn | 162/336 |

FOREIGN PATENT DOCUMENTS

| | | | |
|---|---|---|---|
| 3514554 | 3/1986 | Fed. Rep. of Germany | 162/336 |
| 3538466 | 5/1986 | Fed. Rep. of Germany | 162/336 |
| 843276 | 8/1960 | United Kingdom . | |

*Primary Examiner*—Karen M. Hastings

*Attorney, Agent, or Firm*—Dirk J. Veneman; Raymond W. Campbell; David J. Archer

[57] ABSTRACT

A headbox is disclosed for ejecting stock onto a forming wire of a papermaking machine. The headbox includes an upper, lower, first and second side wall, with each of the side walls extending between the upper and the lower walls such that the upper, lower and side walls define therebetween a slice chamber for the passage therethrough of a primary flow of the stock. A secondary flow of stock is injected laterally relative to the primary flow such that the secondary flow extends through the side walls for controlling fiber orientation along the lateral side edges of the stock ejected from the headbox onto the forming wire.

2 Claims, 2 Drawing Sheets

FIG. 4
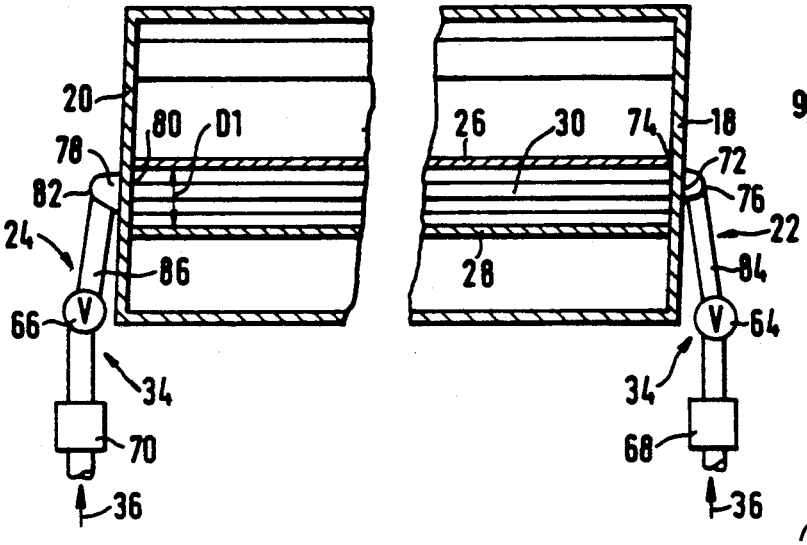
FIG. 6
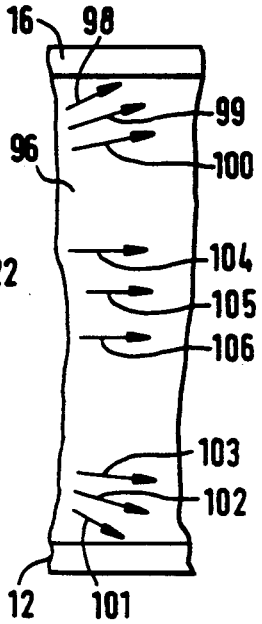
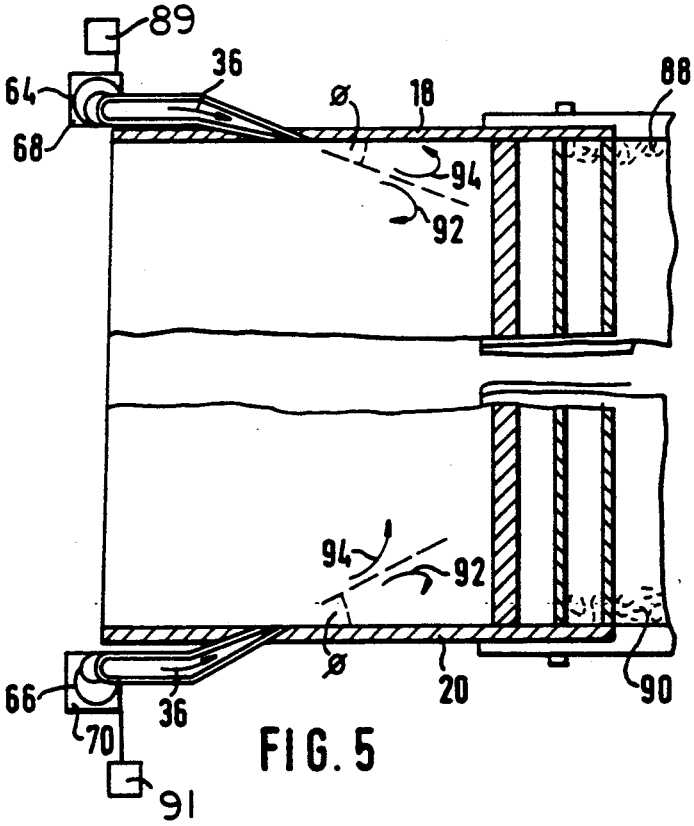
FIG. 5
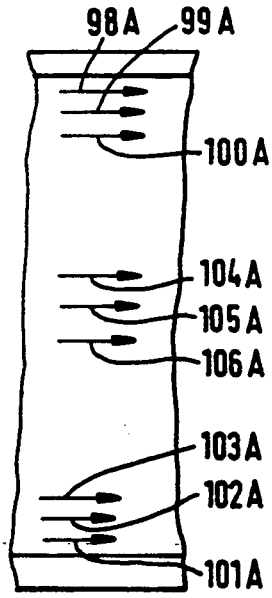
FIG. 7

HEADBOX HAVING A PRIMARY STOCK FLOW AND A LATERALLY INJECTED SECONDARY FLOW

CROSS-REFERENCE TO RELATED APPLICATIONS

This application is a continuation application to application Ser. No. 07/204,046 filed Jun. 8, 1988, now abandoned, which was a continuation in part of application Ser. No. 07/084,610 filed Aug. 10, 1987, now abandoned.

BACKGROUND OF THE INVENTION

1. Field of the Invention

This invention relates to a headbox for ejecting stock onto a forming wire of a papermaking machine. More particularly, this invention relates to a headbox including a slice chamber for the passage therethrough of a primary flow of stock and means for injecting a secondary flow of stock laterally relative to the primary flow.

2. Information Disclosure Statement

In the manufacture of a web of paper or board, a slurry of randomly oriented fibers is ejected from a headbox onto a moving screen or forming wire. Water is drained, or otherwise removed, from the layer deposited on the screen. This formed web is then pressed between cooperating surfaces in order to remove excess moisture from the formed web. Thereafter, the pressed web is guided around a plurality of drying cylinders in order to produce a web having the desired characteristics.

In the formation of a fibrous mat, the fiber orientation within the mat is generally controlled by the jet-to-forming-wire-speed relationship. According to the type of paper or board being produced, such fiber orientation may be caused to a greater or lesser degree so that fiber orientation in a machine-direction may be controlled. The fiber orientation within a typical news sheet can be demonstrated by tearing the sheet in the machine and cross-machine direction. Such sheet tears relatively easily in a machine-direction. However, more resistance to tearing is observable when endeavoring to tear the same news sheet in a cross-machine direction. This variation in tear strength in a machine and cross-machine direction is important relative to the production of newsprint. However, a particular problem exists due to this variation, particularly with regard to the formation of the edges of the formed web.

More particularly, there exists a tendency for the individual fibers within the stock to be deposited in a generally machine-direction orientation. However, at the respective edges of the sheet, the individual fibers tend to spread out to present a fan-shaped orientation. This machine-direction orientation tends to cause wrinkling of the edges of the sheet when these edges pass through the dryer section. Such wrinkling is caused mainly because, as the web is dried, a non-uniform shrinkage occurs in a cross-machine direction due to the lack of fibers deposited in a cross-machine direction.

Various devices have been proposed in an attempt to reorient the fibers within a web such that the fibers at the edges of the web are dispersed parallel to the fibers dispersed in a generally directed machine-direction. However, these prior proposals have been relatively complex and costly and have met with only limited success.

The present invention provides a simple and inexpensive means for orienting the fibers, particularly adjacent to the edges of the web, by injecting a secondary flow of stock laterally into the slice chamber of a headbox such that the tendency for the fibers disposed at the edges of the web to fan out relative to those fibers disposed between the edges is inhibited.

Therefore, it is a primary object of the present invention to provide an apparatus that overcomes the aforementioned inadequacies of the prior art proposals by providing a headbox having means for injecting a secondary flow of stock laterally relative to the primary flow of stock for controlling fiber orientation along the lateral side edges of the stock ejected from the headbox onto the forming wire.

Another object of the present invention is the provision of a headbox having a first and second conduit connected respectively to the first and the second side walls of the headbox for conducting the secondary flow through the side walls into the slice chamber.

Another object of the present invention is the provision of a headbox in which the means for injecting the secondary flow also includes a first and a second valve for controlling the secondary flow through the respective side walls.

Another object of the present invention is the provision of a headbox in which the means for injecting the secondary flow also includes a first and a second flowmeter for measuring the secondary flow through the first and second conduits respectively.

Another object of the present invention is the provision of a headbox in which the secondary flow is injected at an acute angle relative to the respective side walls.

Another object of the present invention is the provision of a headbox in which the general direction of the primary flow and the secondary flow are disposed in the same plane.

Another object of the present invention is the provision of a headbox in which the secondary flow is injected laterally into the primary flow along the entire distance between the upper and the lower wall of the headbox.

Another object of the present invention is the provision of a headbox in which the secondary flow is injected laterally through the side walls into the slice chamber for controlling the orientation of fibers within the primary flow such that along the lateral side edges, the fibers are reoriented so that as the stock is ejected from the headbox onto the forming wire, the lateral edges will be subjected to more uniform shrinkage and uniform physical properties.

Another object of the present invention is the provision of a headbox in which the angle at which the secondary flow is injected into the primary flow may be adjusted to selectively generate clockwise and counterclockwise orientation of the fibers adjacent to the lateral side edges.

Another object of the present invention is the provision of a method for ejecting the stock from a headbox onto a forming wire of a papermaking machine, the method including the steps of passing the stock in a primary flow through a slice chamber and injecting a secondary flow of stock laterally relative to the primary flow such that the secondary flow controls the fiber orientation along the lateral side edges of the stock ejected from the headbox onto the forming wire.

Other objects and advantages of the present invention will be apparent to those skilled in the art from a study of the detailed description taken in conjunction with the drawings and from a consideration of the appended claims which define the scope of the present invention.

SUMMARY OF THE INVENTION

The present invention relates to a headbox and a method for operating such headbox. The headbox ejects stock onto a forming wire of a papermaking machine. The headbox includes an upper and a lower wall and a first and second side wall, with each side wall extending between the upper and the lower walls such that the upper, lower and side walls define therebetween a slice chamber for the passage therethrough of a primary flow of stock. The headbox also includes means for injecting a secondary flow of stock laterally relative to the primary flow such that the secondary flow extends through the side walls for controlling fiber orientation along the lateral side edges of the stock ejected from the headbox onto the forming wire.

More particularly, the upper wall is pivotally-secured relative to the side walls for permitting slice opening adjustment and access to the slice chamber. The upper, lower and side walls define respectively a slice chamber inlet and outlet for permitting the passage therethrough of the primary flow through the inlet and outlet.

The headbox includes a plurality of trailing elements, these elements being disposed within the slice chamber for generating uniformity of flow within the primary flow and for inhibiting the generation of eddies within the slice chamber. Each of the trailing elements has a proximal and a distal end. The proximal ends of the trailing elements are secured relative to the side walls with each proximal end being disposed upstream relative to the distal ends thereof.

The distal ends of the trailing elements freely float within the slice chamber in order to reduce the generation of eddies within the primary flow.

The headbox also includes a slice lip which is adjustably secured relative to the upper wall. The slice lip is disposed downstream relative to the slice chamber inlet for varying the cross-sectional area of the outlet and for controlling the cross-machine direction profile of stock ejected from the headbox.

The means for injecting the secondary flow also includes a first and second conduit means connected respectively to the first and second side walls for conducting the secondary flow through each respective side wall of the slice chamber. Additionally, the means for injecting the secondary flow includes a first and a second valve and a first and a second flowmeter connected respectively to the first and to the second conduit means. The first and second conduit means are disposed relative to the respective side walls so that they define an acute angle therebetween. Such acute angle may be within the range between 1 to 90 degrees and preferably is within the range between 20–40 degrees from the machine-direction.

The primary flow and the secondary flow are both disposed in the same plane. In a preferred embodiment, the secondary flow is injected along the entire distance between the upper and the lower wall. The means for injecting the secondary flow has a flared, nozzle-shaped configuration.

The injecting means is connected to the side walls for injecting a secondary flow of stock through the side walls into the slice chamber for controlling the orientation of fibers within the primary flow such that along the lateral side edges, the fibers are reoriented so that as the stock is ejected from the headbox onto the forming wire, the lateral edges will be subjected to more uniform shrinkage and physical properties. The angle at which the secondary flow is injected into the primary flow may be adjusted to selectively generate clockwise and counter-clockwise orientation of the fibers adjacent to the aforementioned lateral side edges.

The present invention includes a method of ejecting stock from a headbox onto the forming wire of a papermaking machine. The method includes the steps of passing the stock in a primary flow through a slice chamber defined by the headbox and injecting a secondary flow of stock laterally relative to the primary flow such that the secondary flow controls the fiber orientation along the lateral side edges of the stock ejected from the headbox onto the forming wire.

Other objects and advantages of the present invention will be readily apparent to those skilled in the art.

The present invention is not limited by the detailed description contained hereinafter, but rather the invention is defined by the appended claims. Many modifications and variations of the present invention may be made within the spirit and scope of the invention as defined by the appended claims. These variations include injecting the secondary flow into various types of headboxes including the Coverflo, Concept III and Strata-FLo, Converflo headboxes or any other type of headbox.

BRIEF DESCRIPTION OF THE DRAWINGS

FIG. 4 is sectional view taken on the line 4—4 of FIG. 2;

FIG. 5 is a sectional view taken on the line 5—5 of FIG. 1;

FIG. 6 is a plan view of a portion of a newly formed web formed on a forming wire showing the typical fan-shaped orientation of the fibers as indicated by arrows with the fibers at the edges being non-parallel to the orientation of fibers between the edges; and FIG. 7 is a similar view to that shown in FIG. 6 but showing how, by injecting stock sideways into the headbox according to the present invention, all the fibers in a cross-machine direction are disposed parallel relative to each other.

DETAILED DESCRIPTION OF THE PREFERRED EMBODIMENT

Figure 1:
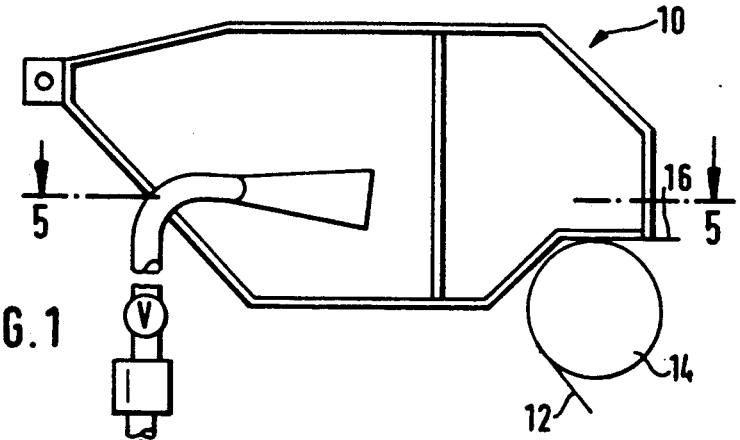
FIG. 1 is a side-elevational view of a headbox according to the present invention.

FIG. 1 is a side-elevational view of a headbox generally designated 10 according to the present invention. The headbox 10 is disposed above a drainage screen 12 which extends around a breast roll 14 such that stock from within the headbox 10 is ejected from the headbox 10 onto the top surface 16 of the forming screen 12 where dewatering of the deposited stock is initiated.

Figure 2:
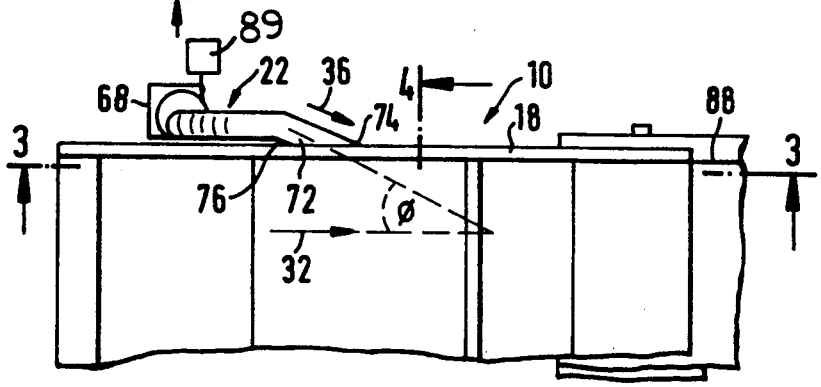
FIG. 2 is a fragmentary top plan view of the headbox shown in FIG. 1.
Figure 2:
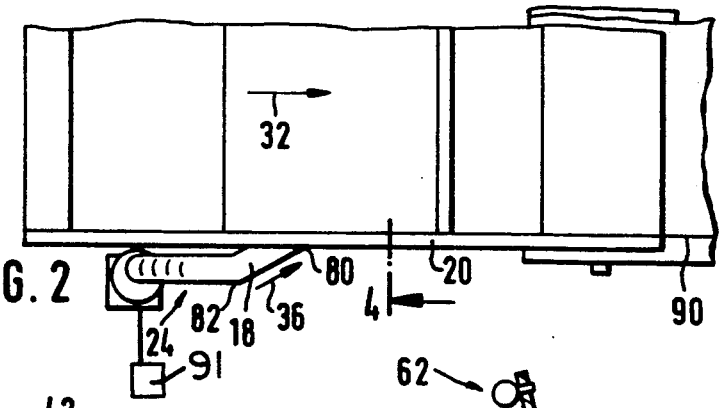

FIG. 2 is a top plan view of the headbox 10 shown in FIG. 1 and shows the headbox 10 having a first and a second side wall 18 and 20 respectively. A first and second conduit means generally designated 22 and 24 respectively, are connected to the side walls 18 and 20 such that a secondary flow of stock is injected through the respective side walls 18 and 20 into the primary flow of stock.

Figure 3:
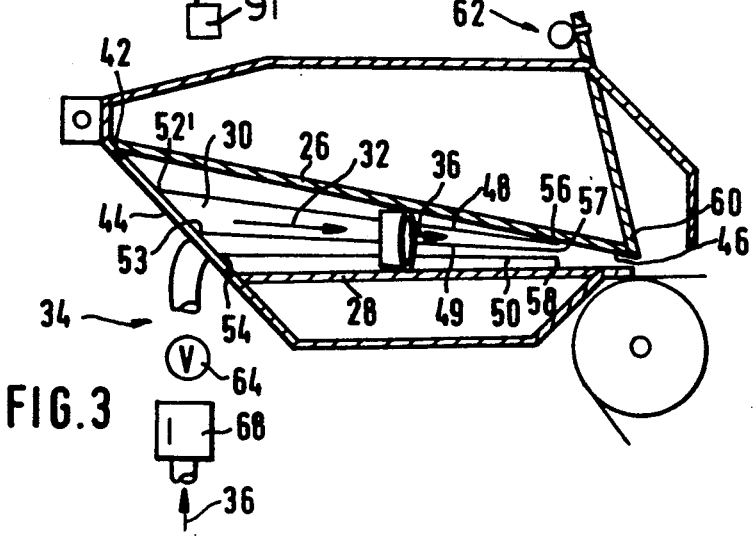
FIG. 3 is a sectional view taken on the line 3—3 of FIG. 2.

FIG. 3 is a sectional view taken on the line 3—3 of FIG. 2 and shows the headbox 10 as including an upper and a lower wall 26 and 28 respectively. The first and second side walls 18 and 20 extend between the upper and lower walls 26 and 28 such that the upper, lower and side walls 26, 28, 18 and 20 define therebetween, a slice chamber 30 for the passage therethrough of a primary flow of stock indicated by the arrow 32. Means generally designated 34 are provide for injecting a secondary flow of stock as indicated by the arrow 36 laterally relative to the primary flow 32. The arrangement is such that the secondary flow 36 extends through the side walls 18 and 20 for controlling fiber orientation along the lateral side edges 38 and 40 of the stock ejected from the headbox 10 onto the top surface 16 of the forming wire 12.

As shown in FIG. 3, the upper wall 26 is pivotally-secured at 42 relative to the side walls 18 and 20 for permitting access and slice opening adjustment to the slice chamber 30.

The upper, lower and side walls 26, 28, 18 and 20 define respectively a slice chamber inlet 44 and an outlet 46 for permitting the passage of the primary flow 32 through the inlet 44 and outlet 46.

A plurality of trailing elements 48, 49 and 50 are disposed within the slice chamber 30 for generating uniformity of flow within the primary flow 32 and for inhibiting the generation of eddies within the slice chamber 30.

Each of the trailing elements 48 to 50 has a proximal and a distal end 52, 53, 54 and 56, 57 and 58 respectively. The proximal ends 52 to 54 are secured relative to the side walls 18 and 20 with each proximal end 52 to 54 being disposed upstream relative to each of the distal ends 56 to 58. The distal ends 56 to 58 freely float within the slice chamber 30 in order to reduce the generation of eddies within the primary flow 32.

The headbox 10 also includes a slice lip 60 which is adjustably secured by a drive motor generally designated 62 relative to the upper wall 26. The slice lip 60 is disposed downstream relative to the slice chamber inlet 44 for varying the cross-sectional area of the outlet 46 and for controlling the cross-machine direction profile of the stock ejected from the headbox 10.

As particularly shown in FIGS. 2 and 3, the means 34 for injecting the secondary flow 36 also includes the first conduit means 22 connected to the first side wall 18 for conducting the secondary flow 36 through the first side wall 18 into the slice chamber 30. Additionally, the second conduit means 24 is connected to the side wall 20 for conducting the secondary flow 36 through the second side wall 20 into the slice chamber 30.

FIG. 4 is a sectional view taken on the line 4—4 of FIG. 2 and shows the injecting means 34 as including a first valve 64 for controlling the secondary flow 36 through the first side wall 18. Furthermore, the injecting means 34 includes a second valve 66 for controlling the secondary flow 36 through the second side wall 20. A first flowmeter 68 measures the flow rate through the first conduit means 22 and a second flowmeter 70 measures the flow rate through the second conduit means 24.

As shown in FIG. 2 and 4, both the first and second conduit means 22 and 24 respectively are connected respectively to the first and second side walls 18 and 20 at an acute angle $\phi$ relative to the respective side walls 18 and 20 such that the secondary flow 36 into the slice chamber 30 flows in a lateral direction relative to the direction of flow of the primary flow 32. Preferably, this acute angle is within the range 20–40 degrees from the machine direction which is parallel to the direction of flow of the primary flow 32.

As shown particularly in FIG. 3, the direction of the primary flow 32 and the direction of the secondary flow 36 are disposed in the same plane.

As shown in FIG. 4, the first conduit means 22 also includes a first portion 72 which is disposed upstream relative to the slice chamber 30 and connected to the first side wall 18. The first portion 72 has a first and second end 74 and 76 as shown in FIG. 2. The first end 4 of the first portion 72 is connected to the first side wall 18 and the first end 74 extends between the upper and lower walls 26 and 28 as shown in FIG. 3 such that the secondary flow 36 is injected laterally into the primary flow 32 along a selected distance D1 between the upper and lowers walls 26 and 28.

The second conduit means 24 as shown in FIGS. 2 and 4, includes a first part 78 disposed upstream relative to the slice chamber 30. The first part 78 of the second conduit means 24 has a first and a second extremity 80 and 82 respectively. The first extremity 80 is connected to the second side wall 20 with the first extremity 80 extending between the upper and the lower walls 26 and 28 respectively such that the secondary flow 36 is injected laterally into the primary flow 32 along the selected distance D1 between the upper and lower walls 26 and 28. In the preferred embodiment of the present invention, as shown in FIGS. 3 and 4, the selected distance D1 is the entire distance between the upper and lower walls 26 and 28. The first portion and first part 72 and 78 respectively are of a flared, nozzle-shaped configuration. The first end and first extremity 74 and 80 respectively are each of elongate configuration such that as the secondary flow 36 flows along respectively the first portion and first part 72 and 78, the secondary flow 36 is injected in a fan-shaped configuration into the primary flow 32.

As shown in FIG. 4, the injecting means 34 also includes a second portion and a second part 84 and 86 respectively with the second portion 84 extending between the first valve 64 and the second end 76 of the first portion 72. The second part 86 extends between the second valve 66 and the second extremity 82 of the first part 78.

As shown in FIG. 5, the angle $\phi$ at which the secondary flow 36 is injected into the primary flow may be adjusted to selectively generate either clockwise or counterclockwise orientation of fibers adjacent to the lateral side edges 88 and 90 as indicated by the arrows 92 and 94 respectively.

The angle at which the secondary flow 36 is injected into the primary flow is adjusted by adjusting means 89 and 91 shown in FIG. 2 and FIG. 5.

FIG. 6 shows a portion 96 of a newly formed fibrous mat formed on the top surface 16 of the forming screen 12. The arrows 98, 99 and 100 indicate the typical orientation of fibers dispersed adjacent to one lateral edge of the fibrous mat. The arrows 101, 102 and 103 show the typical orientation of fibers dispersed on the opposite edge of the mat. The arrows 104, 105 and 106 dispersed sideways between the edges indicate the orientation of fibers in this region with the arrows 104 to 106 being dispersed generally parallel to the machine-direction. The orientation of the arrows 99 to 100 and 101 to 103 is non-parallel to the arrows 104 to 106 which results in non-uniform shrinkage of the resultant web and non-uniform physical properties which cause problems in the drying process.

FIG. 7 is a similar view to that shown in FIG. 6 but shows the results of injecting stock laterally into the headbox according to the present invention. Such lateral injection of stock as shown causes the orientation of the fibers indicated by arrows 98A to 106A to be dispersed parallel to each other. Such parallel disposition of the fibers 98A to 106A results in a more uniform shrinkage of the web and more uniform physical characteristics of the resultant web.

In operation of the apparatus according to the present invention, the primary flow of the stock passes through the slice chamber 30 from the inlet 44 thereof towards the outlet 46 such that the stock is ejected from the headbox 10 onto the upper surface 16 of the forming wire 12. A secondary flow of stock 36 is injected laterally through the side walls 18 and 20 of the headbox 10 into the slice chamber 30 for controlling the orientation of the fibers within the primary flow 32 such that along the lateral side edges 88 and 90 of the forming web, as shown in FIG. 2, the fibers are reoriented so that as the stock is ejected from the headbox 10 onto the forming wire 12, the lateral edges 88 and 90 will be subjected to more uniform shrinkage.

The present invention provides a simple and inexpensive means for improving the condition of the lateral side edges of a formed web to enhance uniform shrinkage therein and for inhibiting wrinkled side edges in the resultant dried web.

What is claimed is:

1. A headbox for ejecting stock onto a forming wire of a papermaking machine, said headbox comprising:

an upper and a lower wall;

first and second side walls, each side wall extending between said upper and lower walls such that said upper, lower and side walls define therebetween a slice chamber for the passage therethrough of a primary flow of the stock;

means for ejecting a secondary flow of the stock laterally into said primary flow in said slice chamber such that said secondary flow extends through said side walls for controlling fiber orientation along lateral side edges of the stock ejected from the headbox onto the forming wire;

a plurality of trailing elements disposed within said slice chamber for generating uniformity of flow within said primary flow and for inhibiting generation of eddies within said slice chamber;

said means for injecting said secondary flow further including:

first conduit means connected to said first side wall for conducting said secondary flow through said first side wall into said slice chamber;

second conduit means connected to said second side wall for conducting said secondary flow through said second side wall into said slice chamber;

said means for injecting said secondary flow further including:

a first valve for controlling said secondary flow through said first side wall;

a second valve for controlling said secondary flow through said second side wall;

said first conduit means further including:

a first portion disposed upstream relative to said slice chamber, said first portion having a first and a second end, said first end being connected to said first side wall, said first end extending from said upper to said lower wall such that said secondary flow is injected laterally into said primary flow along the entire distance between said upper and lower wall;

said second conduit means further including:

a first part disposed upstream relative to said slice chamber, said first part having a first and a second extremity, said first extremity being connected to said second side wall, said first extremity extending from said upper to said lower wall such that said secondary flow is injected laterally into said primary flow along the entire distance between said upper and lower walls; and said first portion and said first part being of flared nozzle-shaped configuration, said first end and said first extremity each being of elongate configuration such that as said secondary flow flows along respectively said first portion and first part, said secondary flow is injected in a fan-shaped configuration into said primary flow.

2. A headbox as set forth in claim 1 wherein said means for injecting said secondary flow further includes:

a second portion extending between said first valve and said second end of said first portion;

a second part extending between said second valve and said second extremity of said first part.

* * * * *

UNITED STATES PATENT AND TRADEMARK OFFICE

CERTIFICATE OF CORRECTION

PATENT NO. : 5,149,402

DATED : September 22, 1992

INVENTOR(S) : Ian W. Riddick

It is certified that error appears in the above—identified patent and that said Letters Patent is hereby corrected as shown below:

Column 6, Line 15: Please delete "4" and insert --74-- in place thereof.

Signed and Sealed this

Twenty-eighth Day of September, 1993

Bruce Lehman

*Attest:*

BRUCE LEHMAN

*Attesting Officer*

*Commissioner of Patents and Trademarks*